US007086401B2

(12) United States Patent
Chiam

(10) Patent No.: US 7,086,401 B2
(45) Date of Patent: Aug. 8, 2006

(54) RESPIRATORY MASK WITH INSERTED SPACER

(75) Inventor: Kia Chee Chiam, Singapore (SG)

(73) Assignee: Megatech Scientific Pte Ltd. (SG)

( * ) Notice: Subject to any disclaimer, the term of this patent is extended or adjusted under 35 U.S.C. 154(b) by 0 days.

(21) Appl. No.: 10/775,408

(22) Filed: Feb. 10, 2004

(65) Prior Publication Data

US 2005/0139217 A1 Jun. 30, 2005

(30) Foreign Application Priority Data

Dec. 31, 2003 (SG) ..... 200307837

(51) Int. Cl.
*A62B 7/10* (2006.01)

(52) U.S. Cl. ..... 128/206.19; 128/206.16

(58) Field of Classification Search ..... 128/201.13, 128/205.12, 205.27, 205.28, 206.17, 206.19, 128/206.16
See application file for complete search history.

(56) References Cited

U.S. PATENT DOCUMENTS

| | | | | | |
|---|---|---|---|---|---|
| 2,176,380 | A | * | 10/1939 | Schwartz | 128/206.16 |
| 2,565,124 | A | * | 8/1951 | Durborow | 128/206.19 |
| 3,613,678 | A | * | 10/1971 | Mayhew | 128/206.19 |
| 3,664,335 | A | * | 5/1972 | Boucher et al. | 128/206.19 |
| 3,699,958 | A | * | 10/1972 | Szucz | 604/304 |
| 3,724,174 | A | * | 4/1973 | Walkenhorst | 96/54 |
| 3,802,429 | A | * | 4/1974 | Bird | 128/206.19 |
| 3,814,094 | A | * | 6/1974 | De Angelis et al. | 128/201.13 |
| 3,884,227 | A | * | 5/1975 | Lutz et al. | 128/206.19 |
| 4,004,584 | A | * | 1/1977 | Geaney | 128/206.14 |
| 4,297,117 | A | * | 10/1981 | Holter et al. | 96/153 |
| 4,386,948 | A | * | 6/1983 | Choksi et al. | 55/499 |
| 4,454,881 | A | * | 6/1984 | Huber et al. | 128/206.15 |
| 4,600,002 | A | * | 7/1986 | Maryyanek et al. | 128/206.19 |
| 4,790,307 | A | * | 12/1988 | Haber et al. | 128/206.19 |
| 4,850,347 | A | * | 7/1989 | Skov | 128/206.16 |
| 4,883,052 | A | * | 11/1989 | Weiss et al. | 128/205.27 |

(Continued)

FOREIGN PATENT DOCUMENTS

WO 00/04957 2/2000

(Continued)

OTHER PUBLICATIONS

The Source of Hydraulic Power: Pumps, Chap. 6: Anthony Esposito; "Fluid Power with Applications"; pp. 175-180.

(Continued)

*Primary Examiner*—Aaron J. Lewis
(74) *Attorney, Agent, or Firm*—Nields & Lemack

(57) ABSTRACT

A respiratory mask that conforms to N95 performance and other high performance standards with improved air permeability for improved air circulation. The respiratory mask has a mask body and a headband for putting on the respiratory mask to the face of a wearer, the mask body consisting of an inside mask having two or more filter layers; an outside mask, having two or more filter layers; one or more spacers inserted between the filter layers of the inside mask to generate space between different filter layers of the inside mask; and one or more spacers inserted between the filter layers of the outside mask to generate space between different filter layers of the outside mask so that when air is discharged by the wearer, the spacers together with the filter layers provide a pumping effect mechanism to blow out more carbon dioxide given off by the wearer to the surrounding and to take in more air from the surrounding for the wearer.

Various forms and shapes of the spacer have been proposed.

14 Claims, 9 Drawing Sheets

RESPIRATORY MASK WITH LINE SPACER

U.S. PATENT DOCUMENTS

| | | | | | |
|---|---|---|---|---|---|
| 5,140,980 | A | * | 8/1992 | Haughey et al. | 128/201.25 |
| 5,269,294 | A | * | 12/1993 | Rogozinski | 128/205.27 |
| 5,291,881 | A | * | 3/1994 | Drews et al. | 128/205.27 |
| 5,307,796 | A | * | 5/1994 | Kronzer et al. | 128/206.16 |
| 5,322,060 | A | * | 6/1994 | Johnson | 128/205.27 |
| 5,400,780 | A | * | 3/1995 | Nishino | 128/205.27 |
| 5,656,368 | A | * | 8/1997 | Braun et al. | 428/141 |
| 5,694,925 | A | | 12/1997 | Reese et al. | 128/206.19 |
| 5,699,791 | A | * | 12/1997 | Sukiennik et al. | 128/206.13 |
| 5,706,803 | A | * | 1/1998 | Bayer | 128/205.27 |
| 5,724,964 | A | * | 3/1998 | Brunson et al. | 128/206.19 |
| 5,794,276 | A | * | 8/1998 | Walker | 2/468 |
| 5,941,244 | A | * | 8/1999 | Yamazaki et al. | 128/206.19 |
| 5,964,221 | A | * | 10/1999 | McKenna | 128/205.12 |
| 6,041,782 | A | * | 3/2000 | Angadjivand et al. | 128/206.19 |
| 6,070,578 | A | * | 6/2000 | Baughman et al. | 128/205.27 |
| 6,375,854 | B1 | | 4/2002 | Beplate | 210/767 |
| 6,397,842 | B1 | * | 6/2002 | Lee | 128/203.26 |
| 6,427,693 | B1 | * | 8/2002 | Blackstock et al. | 128/205.27 |
| 6,695,826 | B1 | | 2/2004 | Villefrance | 604/333 |
| 6,742,518 | B1 | * | 6/2004 | Chang | 128/205.29 |
| 6,772,759 | B1 | * | 8/2004 | Lee | 128/206.19 |
| 6,923,182 | B1 | * | 8/2005 | Angadjivand et al. | 128/206.19 |
| 2002/0170563 | A1 | | 11/2002 | Japuntich et al. | 128/206.12 |
| 2002/0185133 | A1 | | 12/2002 | Japuntich et al. | 128/206.12 |
| 2003/0005934 | A1 | | 1/2003 | Japuntich et al. | 128/206.15 |

FOREIGN PATENT DOCUMENTS

| | | |
|---|---|---|
| WO | 02/24279 | 3/2002 |
| WO | 03/045503 | 6/2003 |

OTHER PUBLICATIONS

Pacific Fishing, Mar. 2001; Boat Keeper; "A Water Pump Primer"; Terry Johnson; 3-pages.

* cited by examiner

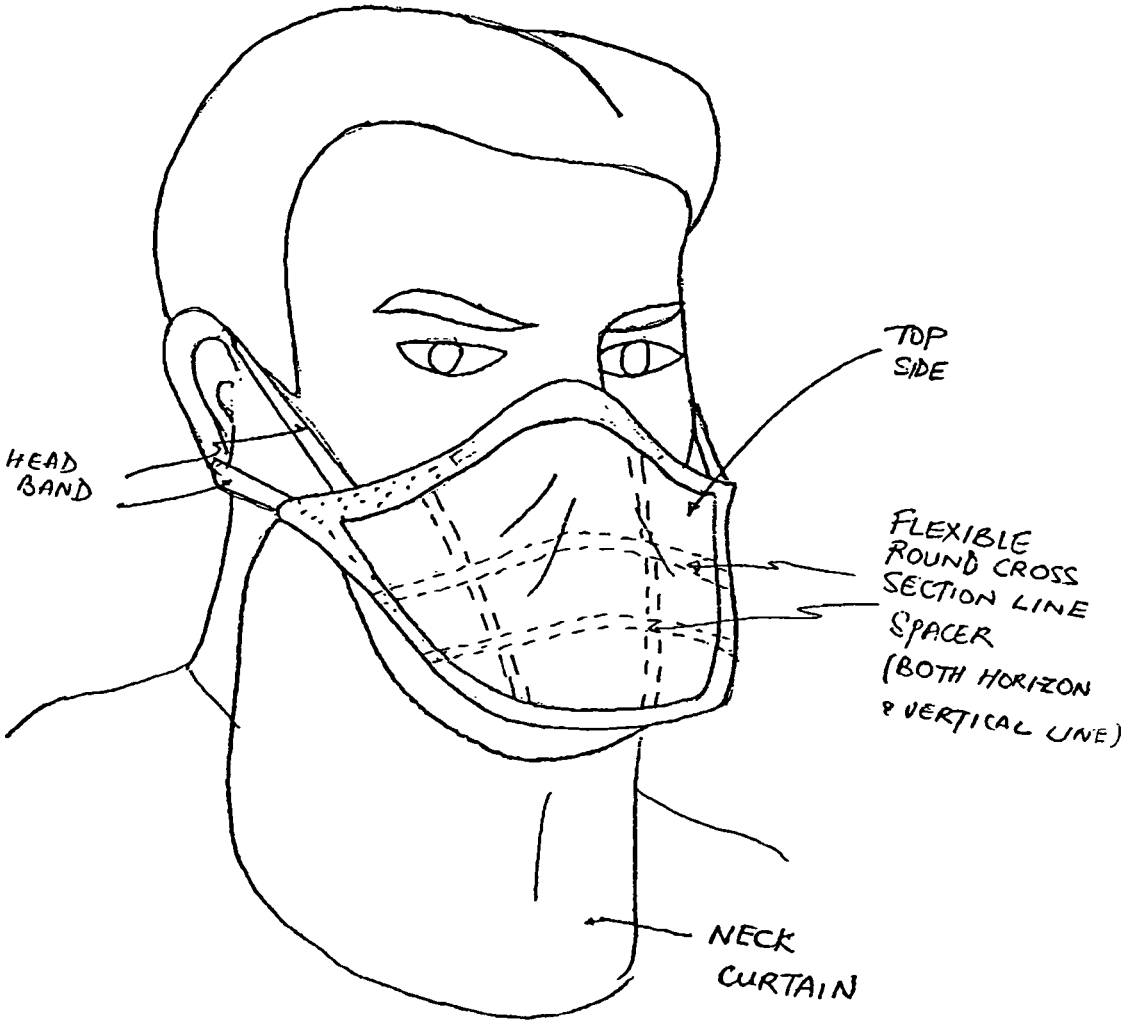
FIG 1 RESPIRATORY MASK WITH LINE SPACER

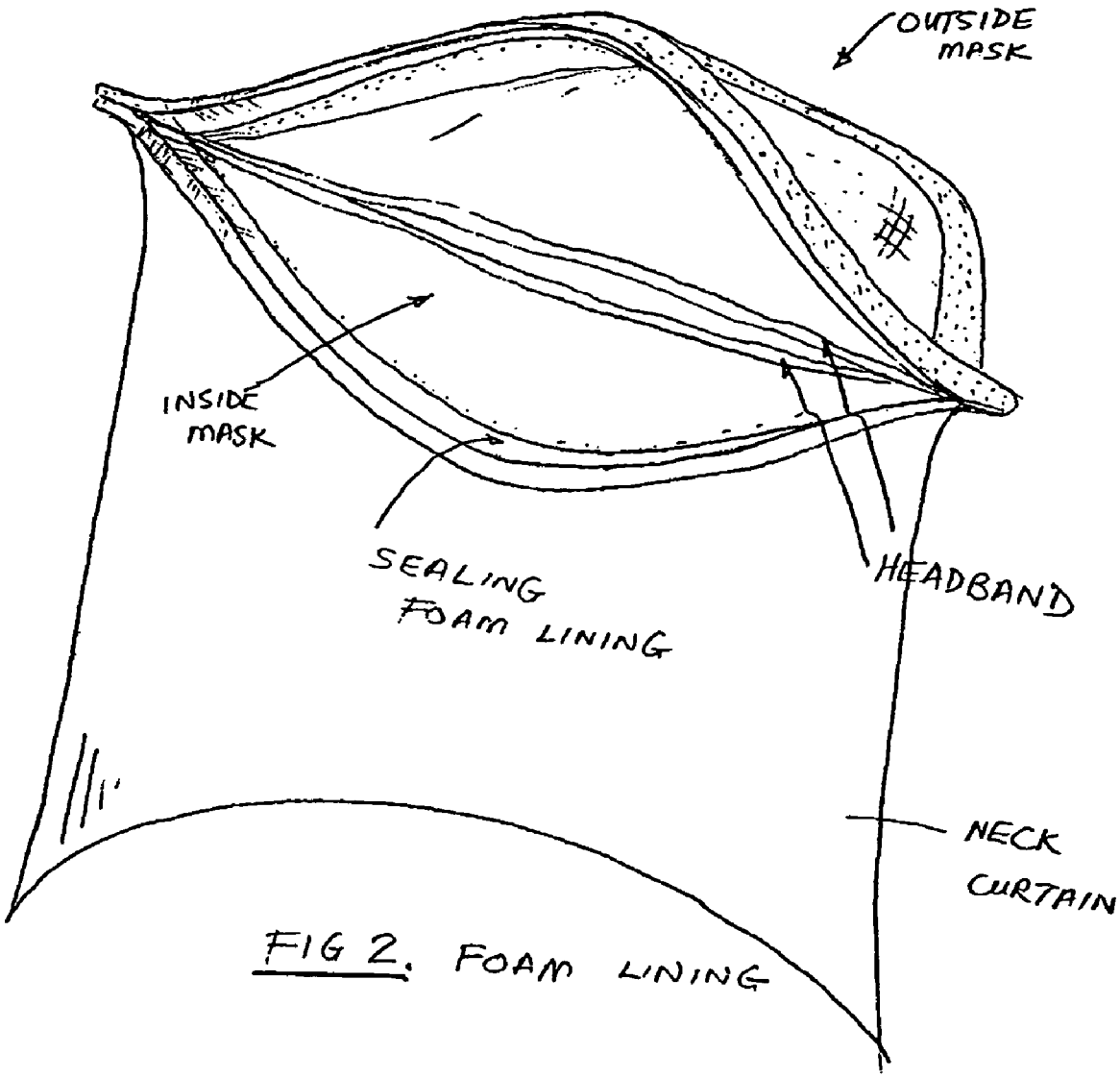
FIG 2. FOAM LINING

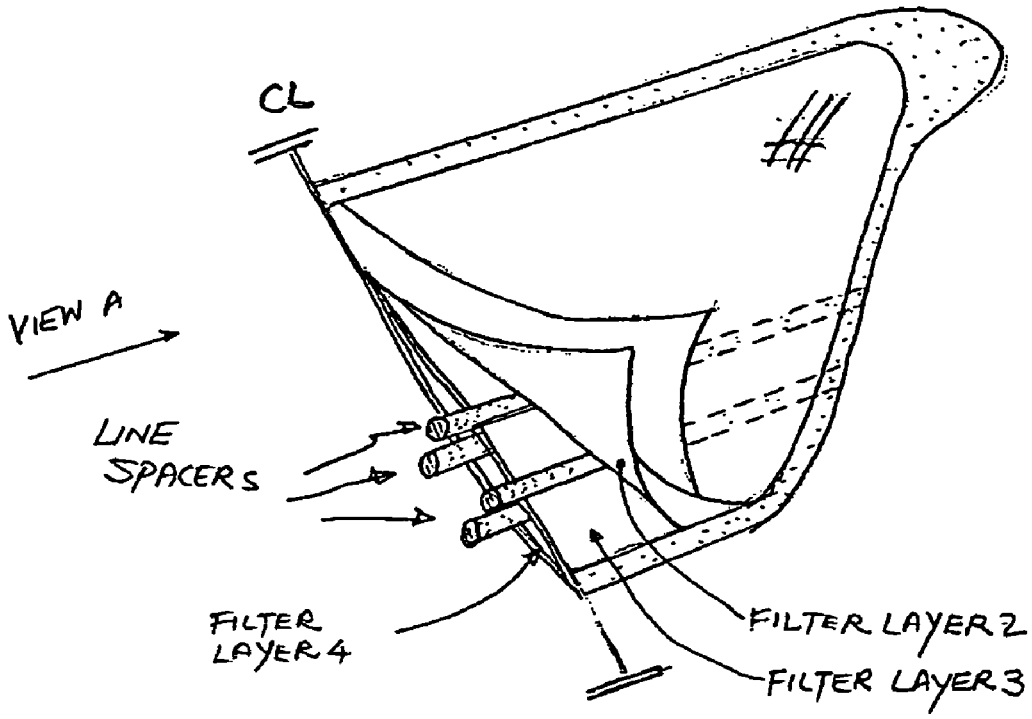
FIG 3a. PARALLEL FLEXIBLE ROUND CROSS-SECTION LINE SPACER
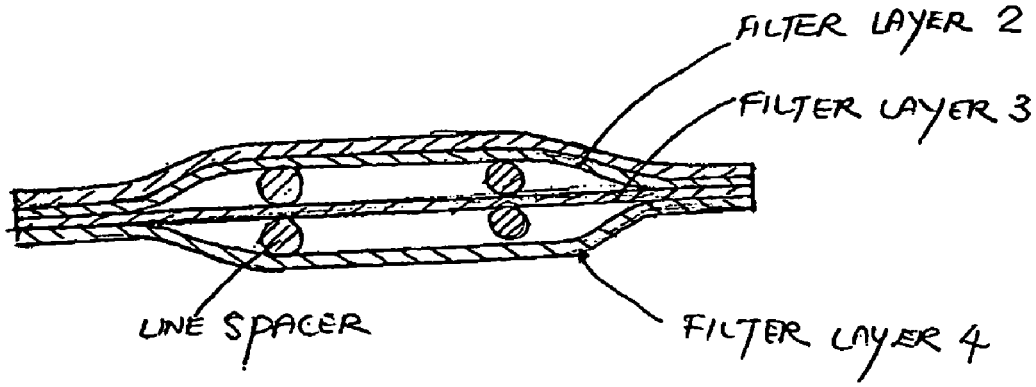
FIG 3b. CROSS-SECTIONAL VIEW OF LINE SPACER

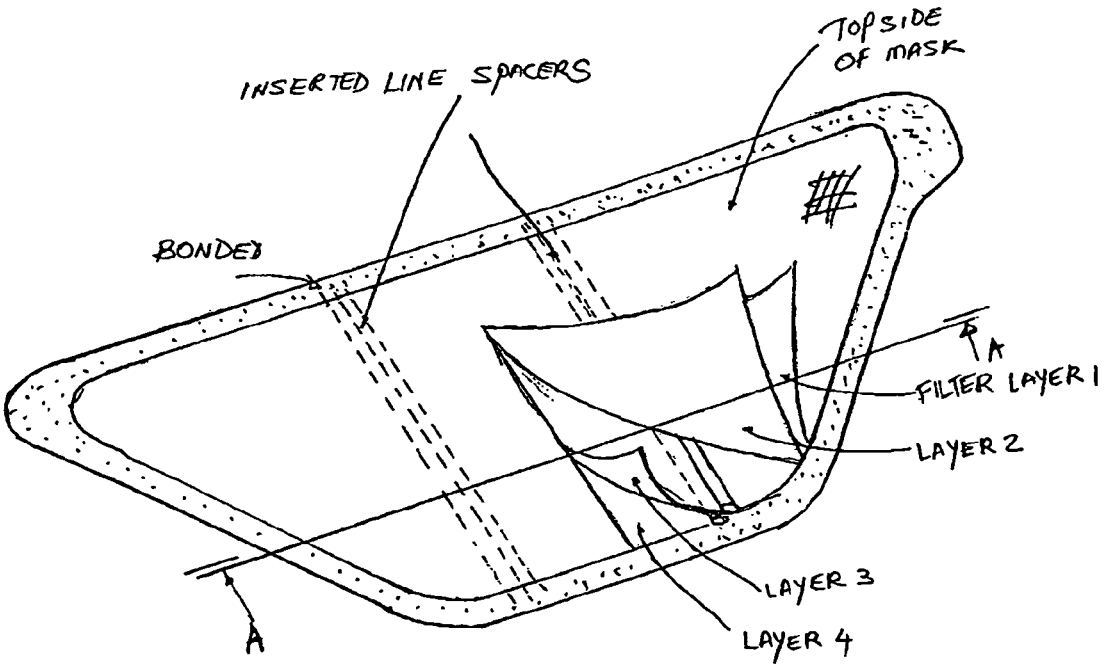
FIG 4a. FLEXIBLE ROUND CROSS SECTION LINE SPACER ALIGNED VERTICALLY
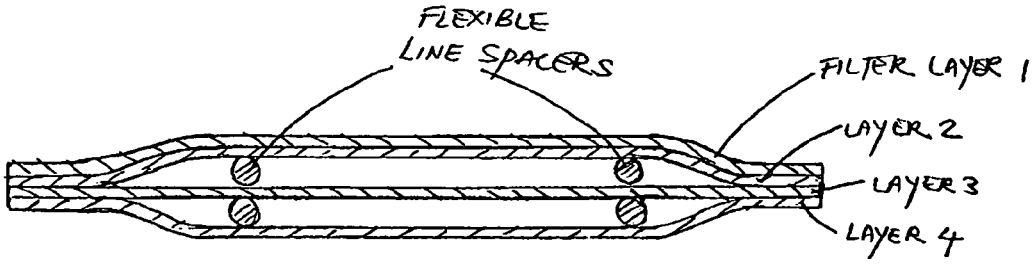
FIG 4b VIEW A

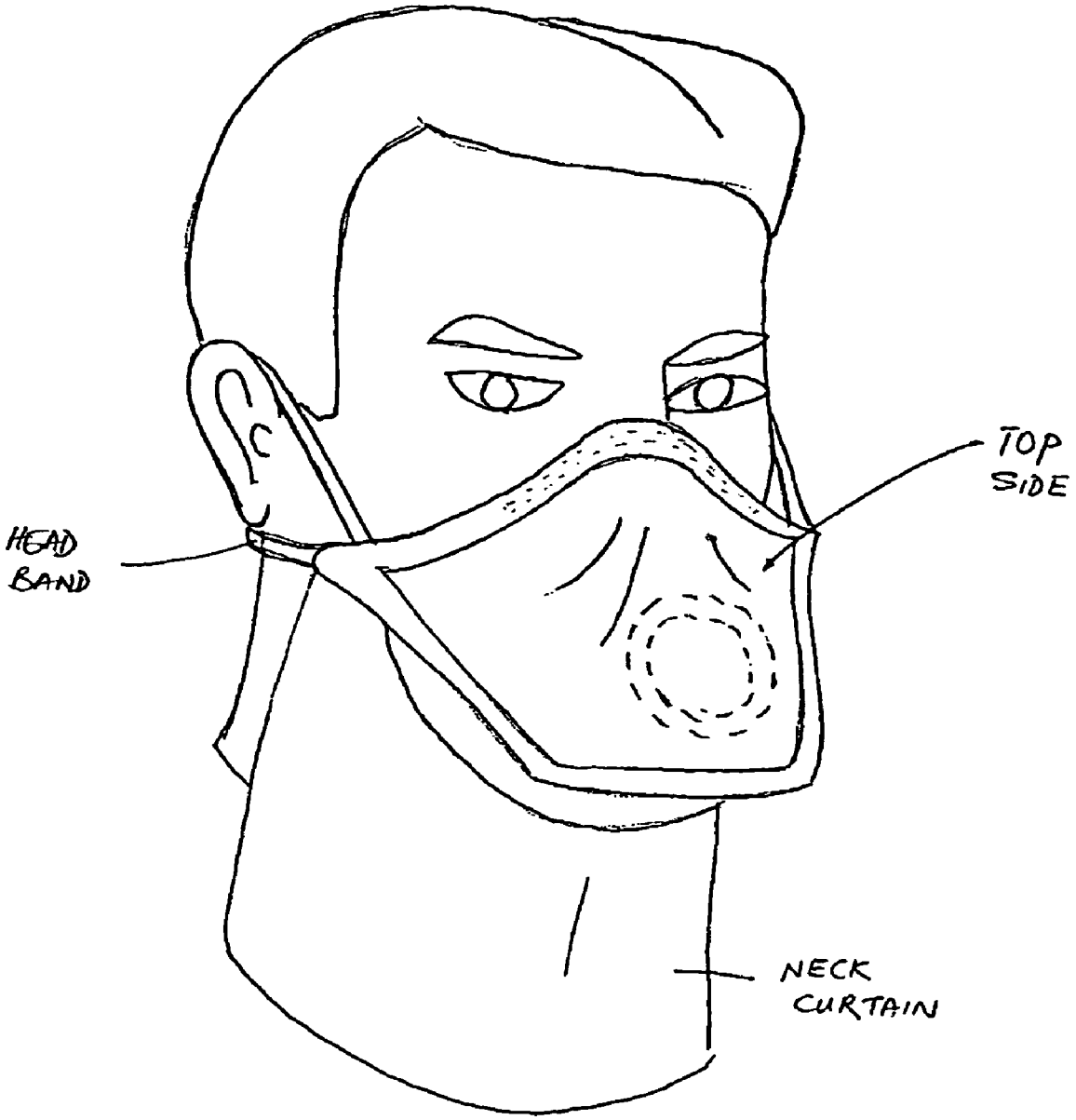
FIG 5. RESPIRATORY MASK WITH GEOMETRICAL SHAPE SPACER (ABOVE SHOWS THE TAPERED CONCENTRIC RING AS A SPECIAL CASE)

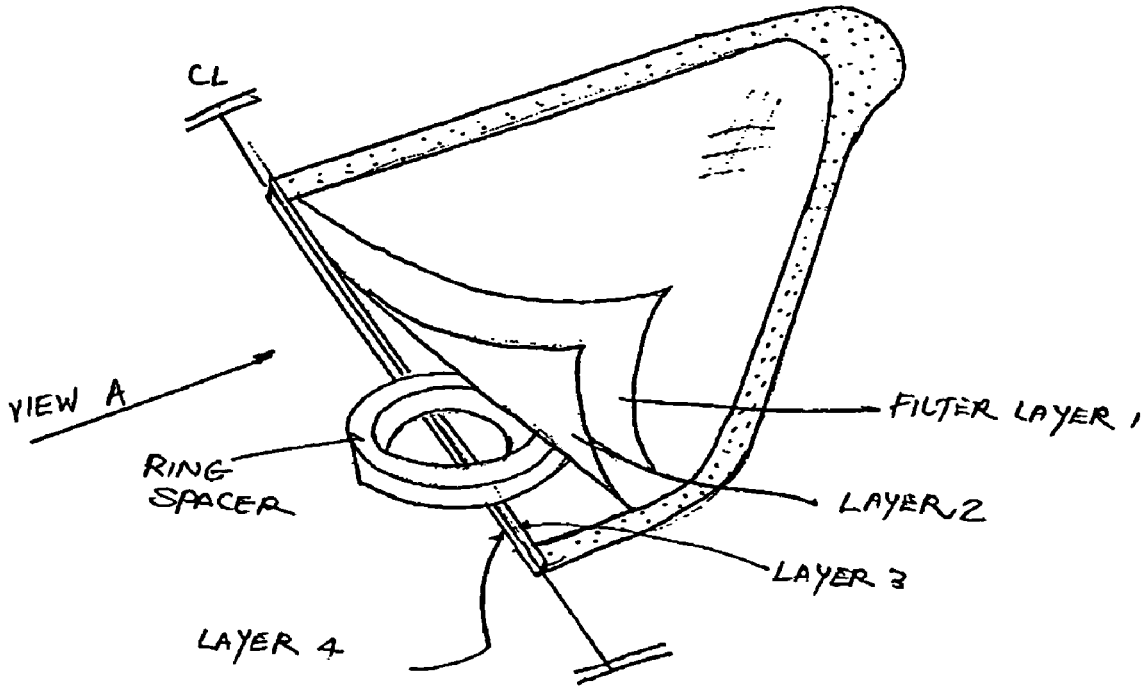
FIG 6a TOP SIDE HALF-PORTION OF THE MASK SHOWING THE GEOMETRICAL SPACER
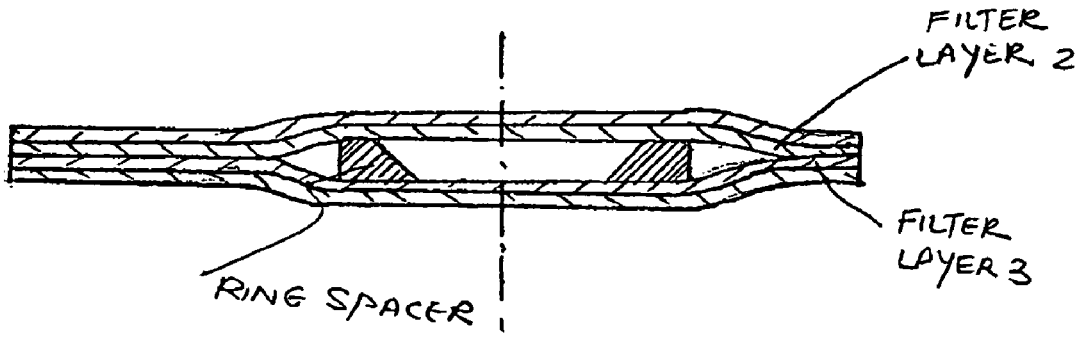
FIG 6b VIEW A

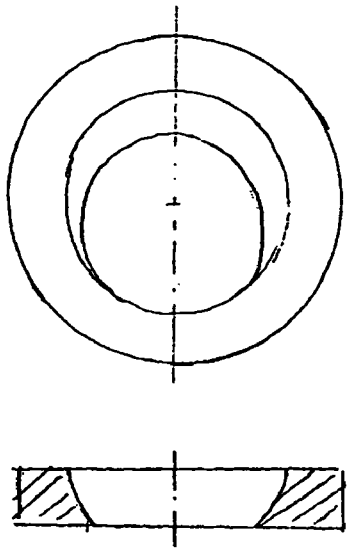
a. TAPERED RING WITH OFFSET INNER HOLE
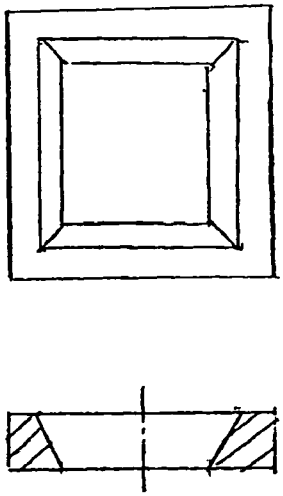
b. RECTANGLE FRAME SPACER
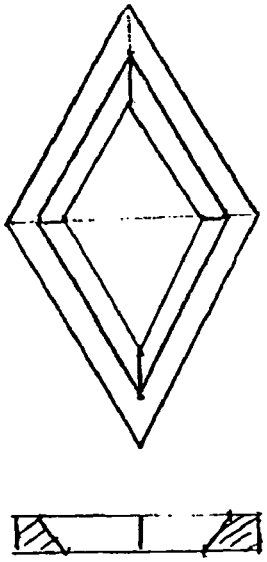
c. DIAMOND/RHOMBUS FRAME SPACER.
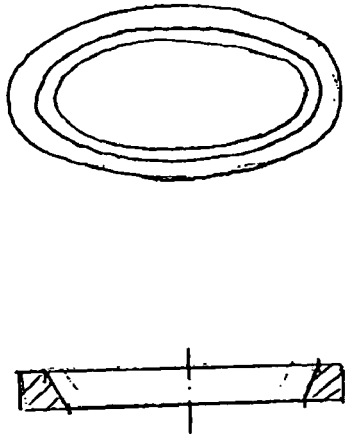
d. ELLIPTICAL SHAPE SPACER
FIG 7. ALTERNATE GEOMETRICAL SPACER SHAPES

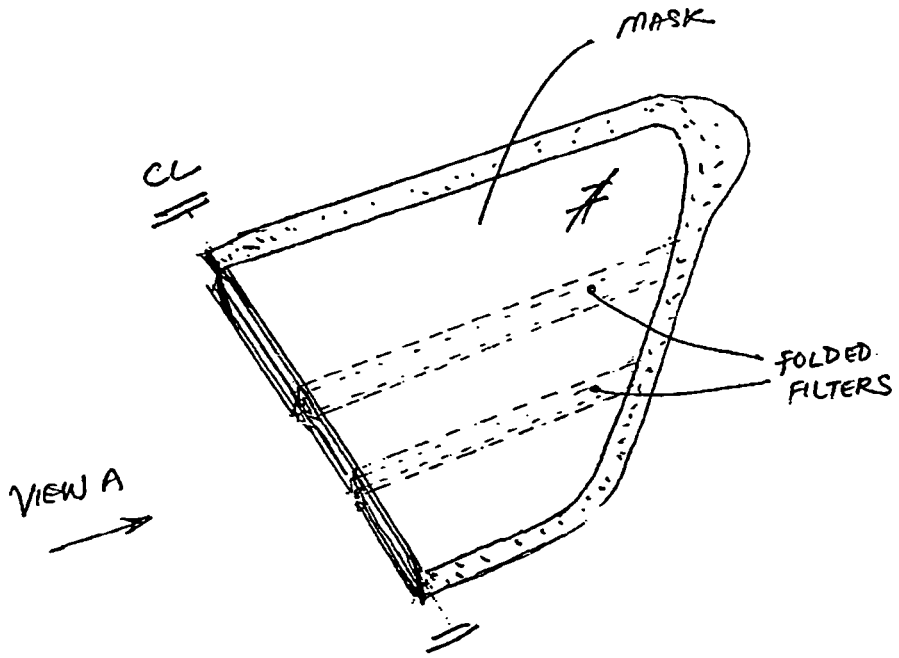
FIG 8a. TOPSIDE HALF PORTION OF THE MASK SHOWING THE FOLDED FILTER SPACER
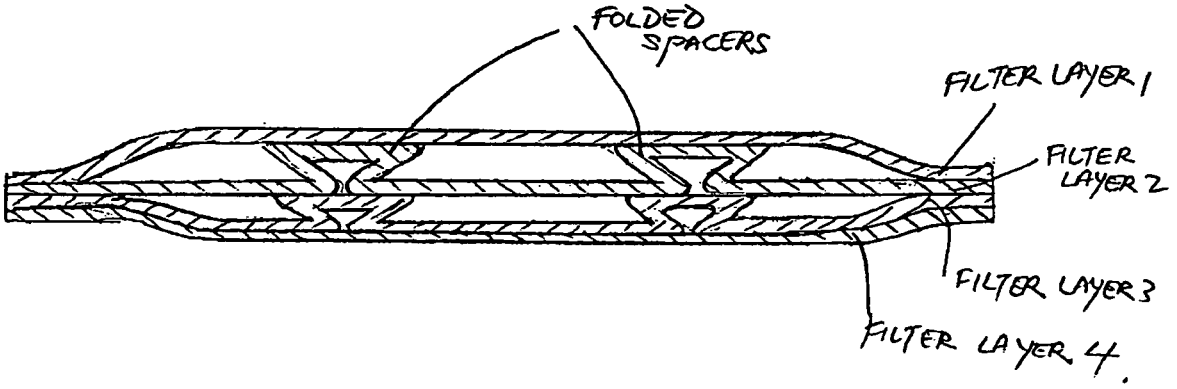
FIG 8b. VIEW A OF THE FOLDS ON THE FILTER LAYER 2 AND 3 TO CREATE SPACING

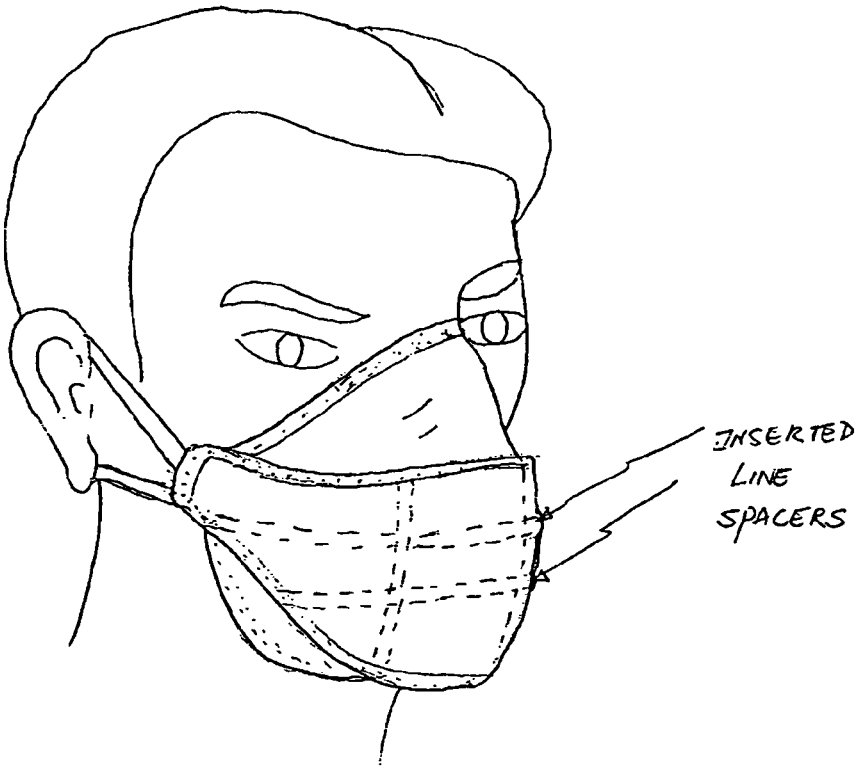
FIG 9a. THREE-PIECE MASK WITH INSERTED SPACERS
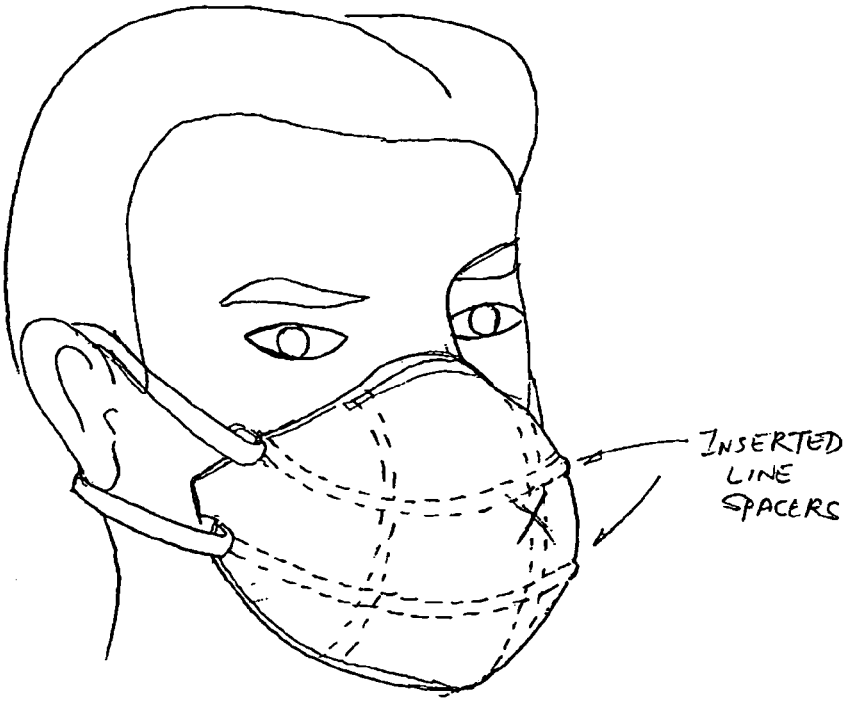
FIG 9b. CUP SHAPE MASK WITH INSERTED SPACERS

RESPIRATORY MASK WITH INSERTED SPACER

BACKGROUND

1. Field of the Invention

This invention relates to respiratory or face mask with improved breathability and wearability.

2. Description of Related Art

Many types of respiratory face masks have been patented. A major problem facing the respiratory or face mask is the accumulation of carbon dioxide in the mask chamber. This accumulation, if not effectively discharged from the mask can be dangerous for the wearer.

Various methods have then been proposed to overcome the problem. The use of a discharge valve may help in discharging the exhaled gas given out by the wearer but it also discharges other contaminants carried by the wearer into the surrounding. Some other improved respiratory masks are costly to manufacture. A low cost respiratory face mask with improved breathability is desired.

The present invention obviates the need for a valve and employs the existing filter layers in the mask and introduces a spacer to address this issue.

PROBLEM TO BE SOLVED BY THE INVENTION

It is an object of the invention to manufacture a respiratory mask that:

1) conforms to N95 performance and other high performance standards in air permeability to improve air circulation in the mask chamber to achieve maximum air circulation in the mask.

Consequently, the mask provides greater safety and comfort to the wearer, while protecting other people from the contaminants exhaled by the wearer and vice versa;

2) provides visual check on the choking of the mask. The choke arises when the filter material trapped more particulates over time. For all currently available masks, it is difficult to check on the choke visually.
3) prolongs donning time.
4) has relatively low manufacturing costs.

DESCRIPTION OF THE INVENTION

A respiratory mask of the current invention covers the nose and mouth of a person. A spacer is inserted in the mask body to create space in between different filter layers on the mask body so that when exhaled air of the wearer is discharged, the gaps in the filter layers created by the spacers together with the filter layers provide a pumping effect mechanism to blow out extra carbon dioxide.

The spacers configures the mask such that during exhalation the individual filter layers are puffed up more apparently to the eyes. A visual indication to change the mask would be when the puff shape increases by roughly fifty percent.

The spacer also acts to separate the filter layers enhancing the ventilation of the moisture produced by the wearer and thus prolongs the donning of the mask.

BRIEF DESCRIPTION OF THE DRAWINGS

FIG. 1 shows a person wearing a respiratory facemask with line spacers on the top side of the mask.

FIG. 2 shows a respiratory mask of the invention.

FIG. 3*a* shows the layers of a respiratory mask of the invention.

FIG. 3*b* shows a cross sectional view of the line spacer of the invention.

FIG. 4*a* shows the layers of a respiratory mask of the invention with another embodiment of the invention.

FIG. 4*b* shows a cross section view of the layers of a respiratory mask of the embodiment discussed in FIG. 4*a*.

FIG. 5 shows the layers of a respiratory mask of another embodiment.

FIG. 6*a* shows the layers of a respiratory mask of the invention with another embodiment of the invention.

FIG. 6*b* shows a cross section view of the layers of a respiratory mask of the embodiment discussed in FIG. 6*a*.

FIG. 7 shows the various shapes of the spacer of the invention.

FIG. 8*a* shows the another embodiment of the invention using folded filter spacers in the layers of a respiratory mask of the invention.

FIG. 8*b* shows the folds on the filter layer of the embodiment discussed in FIG. 8*a*.

FIG. 9*a* shows a three-piece respiratory mask with inserted line spacers.

FIG. 9*b* shows a cup-shaped respiratory mask with inserted line spacers.

DETAILED DESCRIPTION OF PREFERRED EMBODIMENTS

Embodiments of the present invention will now be described with reference to the accompanying drawings.

The respiratory mask should conforms to N95 performance and other high performance standards in air permeability to improve air circulation in the mask chamber so as to achieve maximum air circulation in the mask. The respiratory mask has a mask body and a headband for putting on the respiratory mask to the face of a wearer. The mask body has a few filter layers, which is constructed as follows:

an inside mask having two or more filter layers;

an outside mask having two or more filter layers;

one or more spacers inserted between the filter layers of the inside mask to generate space between different filter layers of the inside mask; and one or more spacers inserted between the filter layers of the outside mask to generate space between different filter layers of the outside mask so that when air is discharged by the wearer, the spacers together with the filter layers provide a pumping effect mechanism to blow out more carbon dioxide given off by the wearer to the surrounding and to take in more air from the surrounding for the wearer.

Referring to FIG. 1, this shows a person wearing a respiratory facemask with line spacers on the top side of the mask.

Referring to FIG. 2, this shows a respiratory mask of the invention, with the outside mask, inside mask, head band, foam lining and neck curtain.

FIGS. 3*a*, 3*b*, 4*a*, 4*b*, 5, 6*a*, 6*b*, 7, 8*a*, 8*b*, 9*a* and 9*b* are various embodiments of the invention. There are a few configurations the spacer can be inserted within the mask's filter layers to achieve the same pumping effect in discharging carbon dioxide and are describe below.

FIGS. 3*a* and 3*b* shows two parallel flexible round cross section line spacers are inserted between the filter layers 2 and 3 and between filter layers 3 and 4 to create space between the said layers. The cross section of the line spacers can also be rectangle or square.

FIGS. 4*a* and 4*b* shows two parallel flexible round cross section line spacers are inserted in perpendicular direction to that described in FIG. 3. The line spacers are also inserted between the filter layers 2 and 3, and between filter layers 3 and 4.

FIGS. 5 and 6 shows that alternatively, a spacer of certain geometrical shape can also be inserted between filter layers 2 and 3. In FIG. 6, the spacer is a concentric ring with tapered inner hole.

FIG. 7 shows the other shapes of spacers proposed, Other geometrical shapes of spacers that can be inserted in filter layer 2 and 3 to serve the same functions are the offset tapered concentric ring, square frame, diamond frame and elliptical.

Spacing configuration can also be achieved by folding the filter layers 2 and 3 in the cross sectional shape of a dovetail running in parallel across the mask as shown in FIG. 8. The dovetail folded layer can be on one, two, three or on all the layers.

The spacers configuration, the foam lining seal and the neck curtain describe above can be implemented on other shape of masks as shown in FIG. 9.

The line spacers can also be installed with the combination of horizontal parallel lines and vertical parallel lines, also as shown in FIGS. 9*a* and 9*b*.

The line spacers can be inserted in just between filter layers 1 and 2, or filter layers 2 and 3, or filter layers 3 and 4, or in all layers or in some layers.

Additionally, if desired, both the top and bottom side of the mask can be inserted with either configuration of spacers as described above to improve performance in discharge of exhaled air.

The spacer or spacers, has the added function of acting as a semi-rigid supporting frame to prevent the mask from collapsing during inhalation.

The respiratory mask comes with foam lining on the opening of the mask as shown in FIG. 2. The foam lining provides air tight sealing to prevent any discharge of contaminant from getting out or into the mask.

A neck curtain is also added to the mask to cover the neck of the wearer as shown in FIG. 1 to prevent the bacteria from penetrating into the mask for wearers who have voluminous, thick and stiff beard.

The spacers when filled with exhaled air shapes the respiratory mask in such a manner that after prolonged periods of use, and when more exhaled air remains within the spacers, the individual filter layers puff up. It then becomes very apparent to the others and to the wearer (upon a quick check with a mirror). Thus, the pumped up spacers serves as a visual guide to the wearability of the respiratory mask. A visual indication to change the mask would be when the puffed up shape of the respiratory mask increases by approximately fifty percent.

Tests have been conducted and these tests showed that the respiratory mask of the subject invention offers improved breathability by improved discharge of exhaled air and improved taking in of air from the surrounding.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

ADVANTAGEOUS EFFECTS OF THE INVENTION

The respiratory mask of the subject invention provides greater safety and comfort to the wearer, while protecting other people from the contaminants exhaled by the wearer and vice versa. It further provides a visual check on the choking of the mask, a feature which currently available masks do not have. With these new features, donning time of the respiratory mask is extended, thereby reducing costs to the institutions using such respiratory masks.

The invention claimed is:

1. A respiratory mask for improved air circulation, said respiratory mask comprising a mask body and a headband for putting said respiratory mask to the face of a wearer, said mask body comprising:

three or more filter layers, each of said layers comprising an outer edge, wherein said outer edges of said three or more layers are joined together such that at least two enclosed volumes are created between adjacent ones of said filter layers; and one or more spacers, each positioned in a respective one of said at least two enclosed volumes, so as to maintain a minimum spacing between the filter layers defining said enclosed volume;

so that when air is discharged by said wearer, the spacers together with the filter layers provide a pumping effect to blow out carbon dioxide given off by said wearer to the surroundings and to take in air from the surroundings for said wearer.

2. A respiratory mask as claimed in claim 1, wherein the spacer enables the puffing up of the mask when there is insufficient exchange of exhaled air with the air from the surroundings, thereby increasing the size of the respiratory mask so as to provide a visual check on the choking of the mask of the wearer.

3. A respiratory mask as claimed in claim 1 wherein the spacer acts as a semi-rigid supporting frame to prevent the respiratory mask from collapsing during inhalation.

4. A respiratory mask as claimed in claim 1 wherein the spacer is of round cross section.

5. A respiratory mask as claimed in claim 1 wherein the spacer is of rectangular cross section.

6. A respiratory mask as claimed in claim 1 wherein the spacer is of square cross section.

7. A respiratory mask as claimed in claim 1 wherein the spacer is an offset tapered concentric ring.

8. A respiratory mask as claimed in claim 1 wherein the spacer is an offset or non-offset tapered square frame.

9. A respiratory mask as claimed in claim 1 wherein the spacer is an offset or non-offset tapered diamond frame.

10. A respiratory mask as claimed in claim 1 wherein the spacer is an offset or non-offset tapered elliptical frame.

11. A respiratory mask as claimed in claim 1 wherein the spacer is made by folding at least one of said filter layers in the cross sectional shape of a dovetail running in parallel across the mask body, either horizontally or vertically or both horizontally and vertically in combination.

12. A respiratory mask as claimed in claim 1 where the respiratory mask comprises a foam lining on the opening of the respiratory mask to provide air tight sealing to prevent any discharge of contaminants from getting out or into the respiratory mask.

13. A respiratory mask as claimed in claim 1 wherein the respiratory mask comprises a neck curtain of sufficient length to cover the neck and any facial hair of a wearer.

14. A respiratory mask as claimed in claim 1 wherein said respiratory mask comprises four filter layers and said spacer is positioned between the two inner filter layers.

* * * * *